US008505599B2

(12) United States Patent
Williams et al.

(10) Patent No.: US 8,505,599 B2
(45) Date of Patent: Aug. 13, 2013

(54) PANELIZATION SYSTEM AND METHOD

(75) Inventors: Martin R. Williams, Phoenix, MD (US); C. Eric Jacobson, Columbia, SC (US); Bill R. Lindley, II, Edmond, OK (US); Brian Jacob Meyer, Columbia, SC (US)

(73) Assignees: Consolidated Systems, Inc., Columbia, SC (US); W&W Steel, LLC, Oklahoma, OK (US)

( * ) Notice: Subject to any disclaimer, the term of this patent is extended or adjusted under 35 U.S.C. 154(b) by 366 days.

(21) Appl. No.: 12/261,909

(22) Filed: Oct. 30, 2008
(Under 37 CFR 1.47)

(65) Prior Publication Data

US 2009/0188194 A1 Jul. 30, 2009

Related U.S. Application Data

(63) Continuation-in-part of application No. 12/019,138, filed on Jan. 24, 2008, now Pat. No. 8,205,412.

(51) Int. Cl.
*E04B 1/18* (2006.01)

(52) U.S. Cl.
USPC ..... 152/414; 52/263; 52/340

(58) Field of Classification Search
USPC ..... 52/263, 262, 414, 459, 460, 461, 52/470, 471, 472, 320, 321, 322, 323, 325, 52/261, 264, 283, 319, 340, 335, 336, 745.05, 52/745.19, 745.2
See application file for complete search history.

(56) References Cited

U.S. PATENT DOCUMENTS

| | | | | | |
|---|---|---|---|---|---|
| 2,033,595 | A | * | 3/1936 | Strehan | 52/260 |
| 2,154,390 | A | * | 4/1939 | Akers | 52/371 |
| 2,995,799 | A | * | 8/1961 | Youtz | 264/130 |
| 3,397,497 | A | * | 8/1968 | Shea et al. | 52/334 |
| 3,867,805 | A | * | 2/1975 | Mikami et al. | 52/742.15 |
| 3,918,222 | A | * | 11/1975 | Bahramian | 52/223.7 |
| 3,956,864 | A | * | 5/1976 | Fung | 52/414 |
| 3,967,426 | A | * | 7/1976 | Ault et al. | 52/252 |
| 4,081,935 | A | * | 4/1978 | Wise | 52/236.8 |
| 4,211,045 | A | * | 7/1980 | Koizumi et al. | 52/251 |
| 4,333,285 | A | * | 6/1982 | Koizumi et al. | 52/252 |
| 4,443,985 | A | * | 4/1984 | Moreno | 52/236.8 |
| 4,597,233 | A | * | 7/1986 | Rongoe, Jr. | 52/334 |
| 4,685,264 | A | * | 8/1987 | Landis | 52/252 |
| 4,741,138 | A | * | 5/1988 | Rongoe, Jr. | 52/334 |
| 4,845,908 | A | * | 7/1989 | Stohs | 174/486 |
| 4,858,398 | A | * | 8/1989 | Ricchini | 52/91.3 |
| 4,951,438 | A | * | 8/1990 | Thoresen | 52/252 |
| 4,972,537 | A | * | 11/1990 | Slaw, Sr. | 14/77.1 |
| 5,050,358 | A | * | 9/1991 | Vladislavic | 52/334 |
| 5,111,627 | A | * | 5/1992 | Brown | 52/126.5 |

(Continued)

*Primary Examiner* — William Gilbert
*Assistant Examiner* — James Ference
(74) *Attorney, Agent, or Firm* — Michael A. Mann; William Y. Klett, III; Nexsen Pruet, LLC

(57) ABSTRACT

A prefabricated panelization system having a floor or roof component and a frame component. In particular, the floor or roof component includes a deck member, which can be made of deck sections, profiles, or panels. For example, the deck member can be made of continuous panels that cover the desired width and length of the floor or roof component without intermediate beams between supporting elements. Alternatively, the deck members can be made of individual or panelized sections that are combined in juxtaposed relation to form the desired width and length. The frame component includes opposing horizontal support channels that are attached to opposing columns, respectfully.

14 Claims, 18 Drawing Sheets

(56) References Cited

U.S. PATENT DOCUMENTS

| | | | | | |
|---|---|---|---|---|---|
| 5,253,460 | A * | 10/1993 | Simenoff | 52/252 |
| 5,640,814 | A * | 6/1997 | Godfrey | 52/143 |
| 5,682,717 | A * | 11/1997 | Carranza-Aubry | 52/251 |
| 5,704,181 | A * | 1/1998 | Fisher et al. | 52/438 |
| 5,809,724 | A * | 9/1998 | Bodnar | 52/414 |
| 5,845,457 | A * | 12/1998 | Wybauw | 52/745.2 |
| 5,864,999 | A * | 2/1999 | Wallin | 52/293.1 |
| 5,901,396 | A * | 5/1999 | Ahlskog et al. | 14/77.1 |
| 5,906,076 | A * | 5/1999 | Mc Manus | 52/126.5 |
| 5,941,035 | A * | 8/1999 | Purse | 52/263 |
| 5,978,997 | A * | 11/1999 | Grossman | 14/73 |
| 6,076,311 | A * | 6/2000 | Godfrey | 52/143 |
| 6,244,005 | B1 * | 6/2001 | Wallin | 52/293.1 |
| 6,543,195 | B2 | 4/2003 | Rahimzadeh | |
| 7,389,620 | B1 * | 6/2008 | McManus | 52/414 |
| 7,571,580 | B2 * | 8/2009 | Miller | 52/650.3 |
| 7,600,283 | B2 * | 10/2009 | Nelson | 14/77.1 |
| 7,845,138 | B2 * | 12/2010 | Groothuis | 52/742.1 |
| 2001/0039773 | A1 * | 11/2001 | Bot | 52/259 |
| 2003/0093961 | A1 * | 5/2003 | Grossman | 52/250 |
| 2003/0097806 | A1 * | 5/2003 | Brown | 52/220.1 |
| 2003/0188496 | A1 * | 10/2003 | Williams | 52/169.1 |
| 2004/0050001 | A1 * | 3/2004 | Williams | 52/292 |
| 2004/0068949 | A1 * | 4/2004 | Richards | 52/334 |
| 2005/0011148 | A1 * | 1/2005 | Hwang et al. | 52/263 |
| 2005/0235590 | A1 * | 10/2005 | Pace | 52/263 |
| 2005/0246988 | A1 * | 11/2005 | Patrick | 52/309.11 |
| 2007/0044426 | A1 * | 3/2007 | Deans | 52/745.19 |
| 2007/0175132 | A1 * | 8/2007 | Spransy et al. | 52/263 |
| 2008/0060293 | A1 * | 3/2008 | Hanlon | 52/251 |
| 2008/0295427 | A1 * | 12/2008 | Termohlen | 52/263 |

* cited by examiner

PANELIZATION SYSTEM AND METHOD

CROSS REFERENCE TO RELATED APPLICATIONS

This continuation-in-part application claims priority to the non-provisional application bearing Ser. No. 12/019,138 filed Jan. 25, 2008 now U.S. Pat. No. 8,205,412.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

The present invention relates generally to panelization systems and, more particularly, to systems employing prefabricated frames and deck pans for constructing floors, roofs, or platforms of buildings or other structures.

Some concerns in building construction and design are minimizing costs, maintaining a safe working environment, and maximizing architectural flexibility and creativity. Striking a balance among these often-competing concerns is the challenge faced in developing panelization systems. The present invention incorporates unique construction methods that assure uniform quality, increased safety, reduced labor and material costs, and permit architectural flexibility.

Assuring worker safety is a paramount concern during the construction phase of any building, particularly high-rise structures. Typically, the installation of prefabricated floor or roof modules, as opposed to traditional piece by piece assembly, promotes job-site safety. Assembling components at ground level assures that less labor will be required at elevated levels. Additionally, once modules are in place, workers of all trades are provided an immediate platform on which they can perform their tasks.

Accordingly, there exists an opportunity for a panelization system that provides convenient, flexible components that are easily preassembled and installed.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention includes a panelization system having a floor or roof component (e.g., a composite deck system), a frame component, and, optionally, a spandrel beam system, a layer of concrete, or both. These components, or combinations thereof, are combined to form panels. The frame component includes horizontal support beams on four sides or, optionally, horizontal support beams on three sides and a spandrel beam system on the fourth side. Two of the horizontal support beams are attached to opposing columns. The horizontal support beam elements are not limited to a specific shape, and can be generally channel beams or wide-flange beams, and include a top flange that is dimensioned to support each end of the deck member. The deck member can also be supported by a ledger angle fixed to the vertical web of the horizontal support beam element. The spandrel beam system is a horizontal structural component comprised of a multiplicity of individual elements. Additionally, a plurality of panels as herein described can be combined to form a building having multiple areas and levels.

The present invention further includes a method for constructing a panelized floor, roof, or platform and is therefore referred to as a panelization method. The steps of the method include: 1) providing columns that are spaced apart so as to establish panelization system perimeters in a building or any particular area within a building; 2) providing a horizontal frame; 3) providing a deck; 4) connecting the horizontal frame and the deck to form a panel; 5) lifting the panel into position between the columns; 6) and connecting the panel to the columns. Additionally and optionally, the method of the present invention can include the step of constructing a spandrel beam system as a part of the frame, placing a layer of concrete on the panel, or both.

A feature of the present invention is the use of horizontal support beam elements that are connected to columns in such a way as to define space for mechanical/electrical/plumbing (MEP) components and connections between the beams. Traditional framing systems use wide-flange beams between and along the centerline of columns to provide support for floors, roofs or platforms. These typical framing systems leave no space for the MEP components and connections. Rather, space for MEP components and connections must be formed or constructed later, as a separate step in building construction. By using beams that are connected to opposing sides of four-sided columns, rather than to the centerline of the column, spaces are created between the beams at and along the centerline of the columns. These spaces between beams and between the columns permit great design flexibility for positioning and connecting MEP components while reducing construction labor time and costs.

Another feature of the present invention is a method of constructing floors or roofs using the panelization system that consumes less time and is safer than the practices of the prior art. Using a floor structure as an example, traditional construction methods require individual banded bundles of floor components to be lifted onto individually installed horizontal support beams. The bundles are then unbanded and individual floor components are distributed over the beam elements. The individual floor components are then attached to the beams. This process becomes increasingly challenging and time-consuming as the height of the building increases, increasing concern for safety and adding expense to the construction of multi-story buildings.

The present invention, however, provides a method for assembling a complete, panel system (without the layer of concrete) on the ground, and then lifting the preassembled panel onto temporary support elements fixed to the columns at the desired building elevations. For example, the panelization system of the present invention encompasses placing preassembled floor or roof panels of various sizes directly into place "at height" in the building. Because these panels incorporate beams that run along the sides of columns and not directly between and along the centerline of the columns, the panels can be set in place on temporary support elements before being permanently attached to the columns. This alleviates the need to place, suspend, or otherwise secure the construction components in their exact final position before permanently attaching them. In short, the maneuvering and installation of individual floor or roof panels and frame components "at height" is completely avoided.

The fact that the horizontal frame of the present invention is supported on temporary support elements on the sides of columns also increases the speed with which a multi-story building can be constructed. For example, in traditional piece by piece construction, a crane is required to hold a particular component in position while it is being attached to the building's vertical and/or horizontal frame. With the present invention, the floor or roof panel is simply rested on temporary support elements and left in place by the crane operator. The crane is then free to begin raising a second panel while the first is being permanently attached to the columns.

There are also several aspects of the present invention that allow for a safer worksite. First, the panelization system of the present invention allows for more work to be conducted at ground level as opposed to "at height." Naturally, all other factors being equal, it is safer to conduct work on the ground than it is to conduct work elevated well above the ground. Moreover, floor or roof panels can be outfitted with safety railings on the ground to thereby provide immediate fall protection once the floor or roof panel is lifted into place. Finally, the use of temporary support elements for the panels provides a place for workers to stand while a panel is placed on the opposing side of a column. This would not be possible if the frame component was attached to the top or along the centerline of the column instead of to the side of the column as in the present invention.

Another feature of the present invention in a floor or roof application is the use of a spandrel beam system that can match the overall depth of the floor or roof component. In building construction, the beam that extends from column to column at the boundary or exterior edge and marks the floor or roof level between stories is commonly referred to as a spandrel beam. Spandrel beams are designed to support the vertical and lateral loads imposed by the exterior fascia of the building, also referred to as the curtain wall. Spandrel beams can also support floor or roof gravity weight loads. Traditionally, the challenge has been providing reinforcement to the spandrel beam without increasing the thickness of the floor or roof component, and thereby avoiding the need for a deeper beam section at the exterior. These deeper beam sections form a bulkhead that reduces the field of vision and limits architectural and aesthetic flexibility. The top and bottom of the spandrel beam system of the present invention can be flush with the top and bottom of the floor or roof component of a building. Accordingly, the spandrel beam system accomplishes the challenging task of supporting a curtain wall, while still providing an uninterrupted ceiling, without a bulkhead adjacent to the curtain wall. The spandrel beam system of the present invention can also be used as a drag strut which is an integral part of a building's lateral support system.

Another feature of the present invention is the ability to place MEP items and other building components on the panel when the panel is on the ground, thus further minimizing work done "at height."

Another feature of the present invention is the ability to temporarily store various construction materials and equipment on the panel prior to the panel being raised and installed. Once the panel is installed, the temporarily stored materials can be offloaded or otherwise distributed. Furthermore, the installed panel comprises a safe platform upon which workers can immediately begin working. All of these features contribute to a safer and more efficient construction site.

Other features and advantages of the present invention will be apparent to those skilled in the art from a careful reading of the Detailed Disclosure of the Embodiments presented below and accompanied by the drawings.

DETAILED DESCRIPTION OF THE EMBODIMENT

Figure 1:
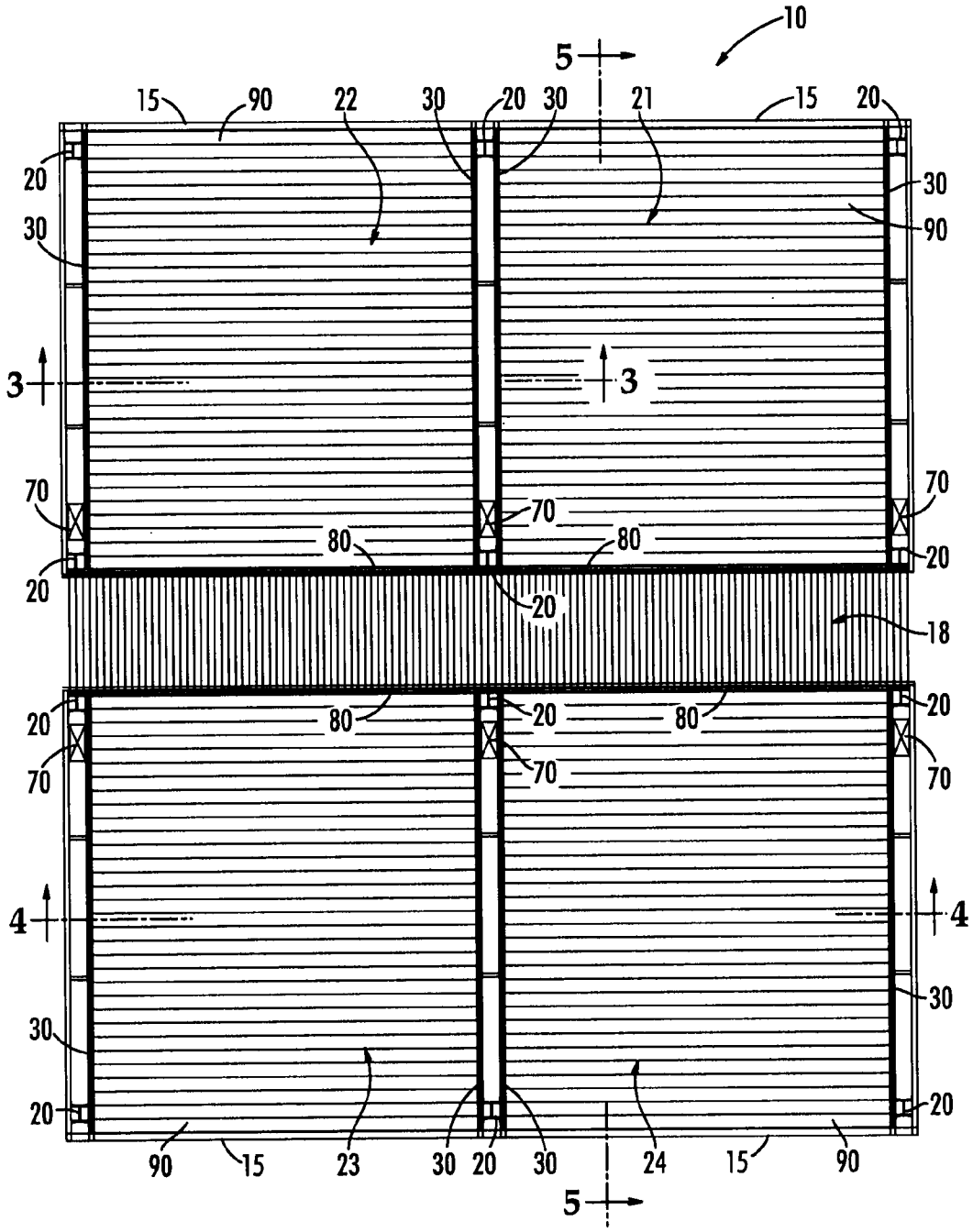
FIG. 1 is a plan view showing a plurality of exterior preassembled panels and an interior field-installed panel, according to one embodiment of the present invention.

The present invention is a panelization system and method. As illustrated in the drawings and in particular the embodiment in FIG. 1, the panelization system 10 is comprised of exterior preassembled panels 21, 22, 23, and 24, and a field installed interior partition 18. Each of the exterior floor or roof panels 21, 22, 23, and 24 includes a floor component, such as deck 90, and a frame 30. The panelization system 10 of the present invention is ideal for use in a variety of construction projects, not just for flooring, and is easily interfaced with a variety of conventional construction components. By way of example and not limitation, the panelization system 10 of the present invention is shown as being incorporated into a building having a plurality of columns 20 that form the perimeters of the four floor panels 21, 22, 23, and 24.

Figure 2:
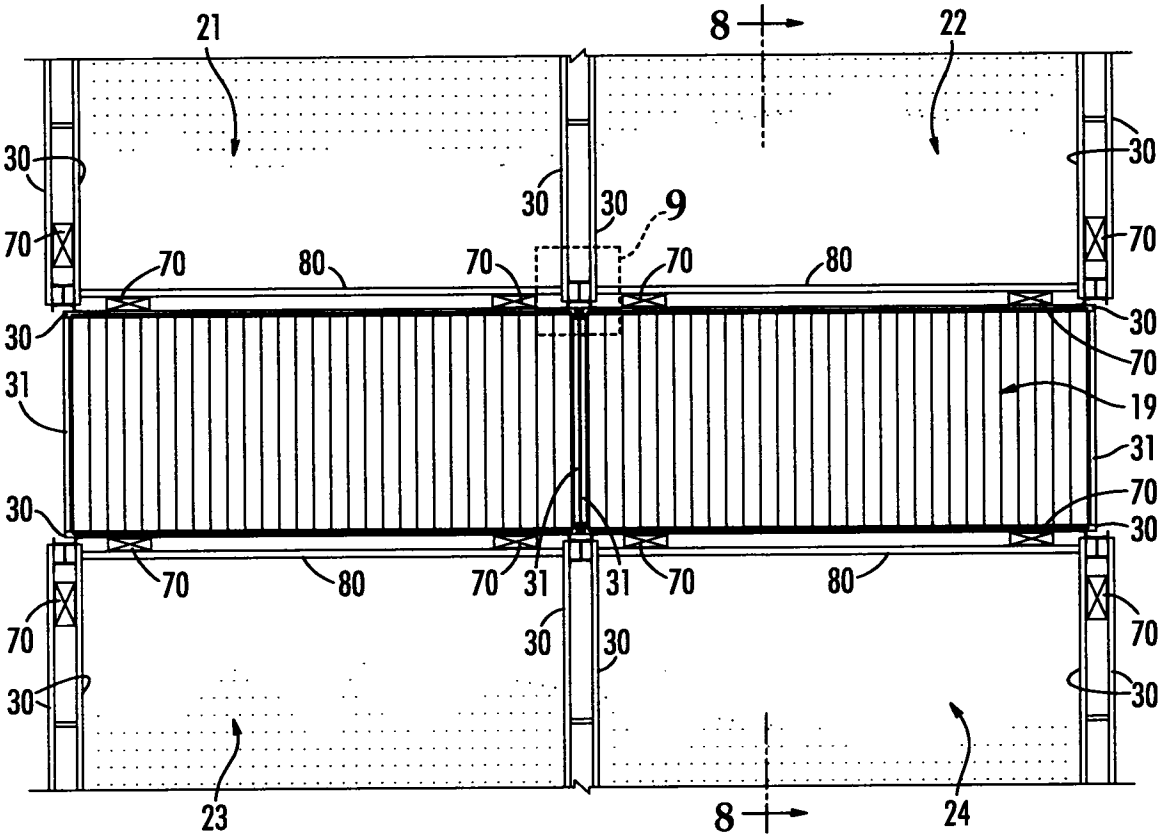
FIG. 2 is a plan view showing a plurality of interior preassembled panels according to an alternative embodiment of the present invention combined with a plurality of exterior panels.

As further illustrated in FIG. 1, adjacent pairs of exterior panels (i.e. 21, 22 and 23, 24) are attached to both sides of columns 20 with columns 20 between the adjacent panels. Note also that the first and second panels, 21 and 22, are separated from the third and fourth panels, 23 and 24, by an interior partition 18 that spans to the perimeter of an interior space and serve, for example, as a corridor. The interior partition 18 can be a non-panelized, field-installed system comprised of individual deck pans as illustrated in FIG. 1 or, alternatively, the interior partition 19 (FIG. 2) can be preassembled in a manner similar to the panelization system of the exterior panels, wherein panelized deck pans are utilized. FIG. 2 is a closer plan view of the interface between the four preassembled exterior panels 21, 22, 23, and 24 and a panelized interior preassembled partition 19.

Figure 3:
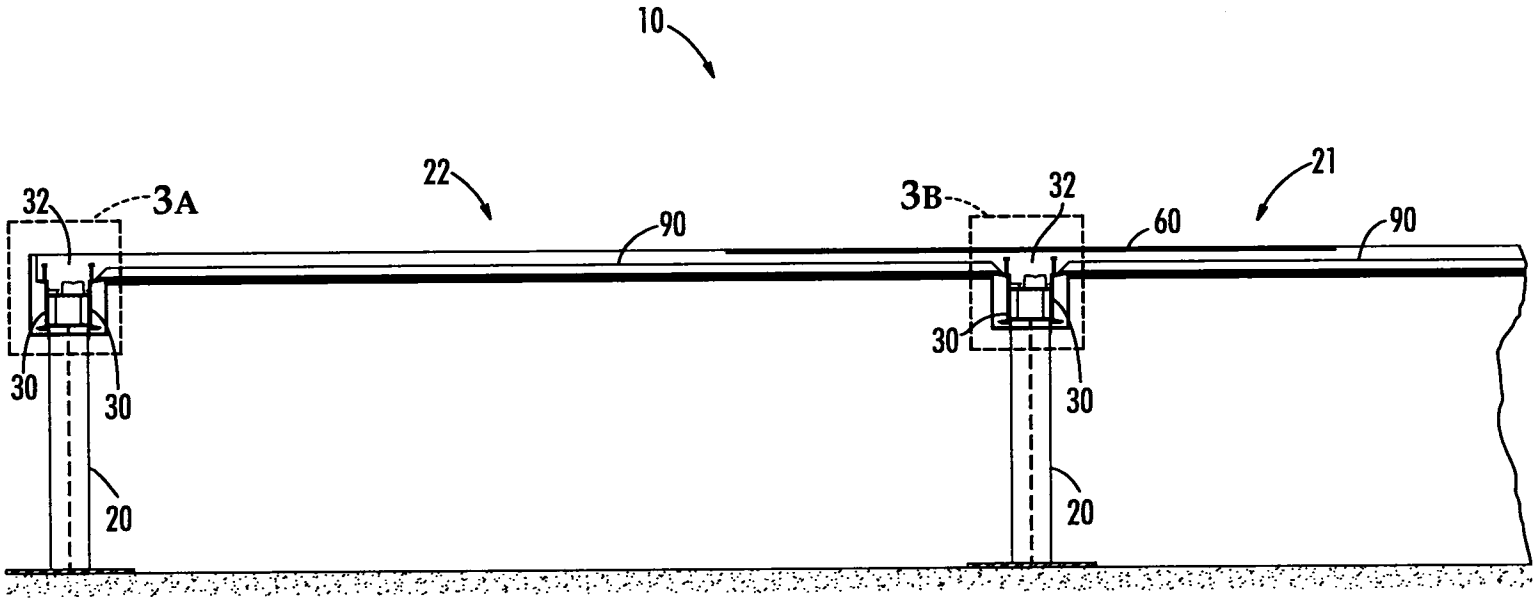
FIG. 3 is a cross-sectional view (taken at line 3-3 shown in FIG. 1) of an exterior preassembled panel according to one embodiment of the present invention.
Figure 3A:
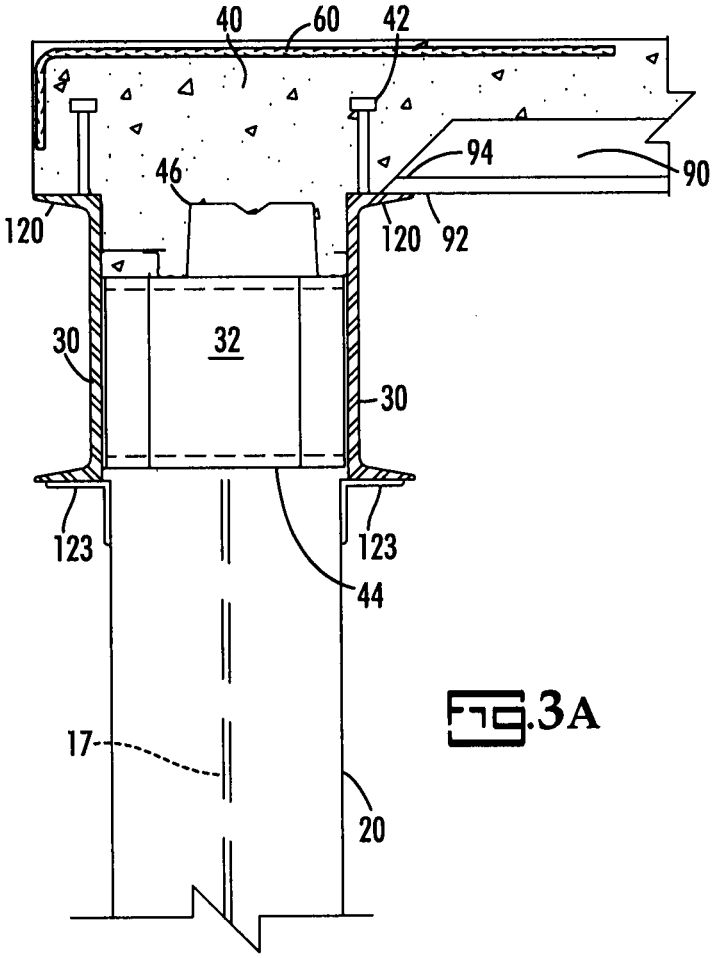
FIG. 3A is an enlarged cross-sectional view (taken at detail 3A of FIG. 3) of an exterior composite panel according to one embodiment of the present invention.
Figure 3B:
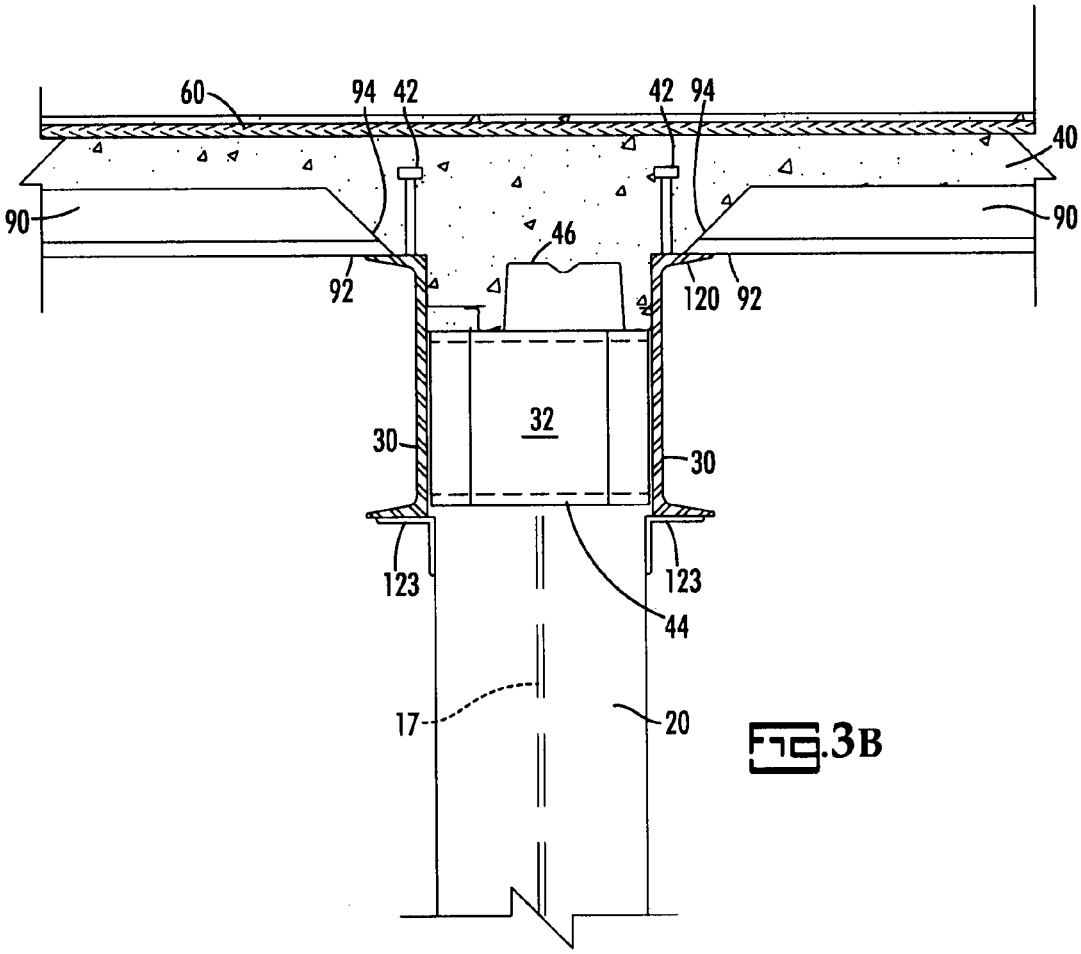
FIG. 3B is an enlarged cross-sectional view (taken at detail 3B of FIG. 3) of an exterior composite panel according to one embodiment of the present invention.

FIG. 3 is a cross-sectional view (taken along Section 3-3 in FIG. 1) of the panelization system 10. Additionally, the areas of attachment of the panelization system 10 are detailed in FIGS. 3A and 3B. As illustrated, frame members 30 of the exterior panels 21 and 22 are connected to columns 20. Specifically, frame members 30 shown in FIGS. 3, 3A, and 3B are comprised of horizontal channel beams that are attached to opposing sides of columns 20 with the channel flange extending outward, away from column 20.

Generally, frame 30 is dimensioned to support exterior panels 21, 22, 23, or 24. In FIGS. 3A, 3B, (as well as 4A, 4B, 5A, 5B, and 5C), the component of floor panels 21, 22, 23, 24 supported by frame 30 is metal deck 90. In particular, frame 30 typically includes a top flange 120 that supports ends 94 of deck 90. In this embodiment, frame 30 supports deck 90 without intermediate beams (e.g., joists or purlins) or other supports. Also, as seen in FIGS. 3A and 3B, supporting frames 30 on opposing sides of the columns 20 create space 32 between the frames 30 along the centerline 17 of the columns 20 and between the columns 20. This space 32 can be very useful in the construction of the building, as explained below.

As previously described, a feature of the present invention is the use of frames 30 that are connected to the sides of columns 20. Prior art systems use horizontal wide-flange beams spanning directly between and along the centerlines of columns to provide support to floor or roof components. Because of the shape of wide-flange beams, the attachment of the beams between the columns consumes all of the space between the columns. By using frames 30 that are connected to the sides of columns 20, space 32 is created along the centerline and between the columns 20. This space 32 provides flexibility in design and installation of utilities and allows for the vertical passage of other building components such as mechanical, electrical, plumbing, communication, etc. through floors or roofs.

Referring again to FIGS. 3A and 3B, by way of example and not limitation, a pourable, continuous layer of concrete 40 can be placed over decking 90 and within the confines of frame 30 to further complete the construction of the building floor or roof panels 21, 22, 23, and 24. Frame 30 optionally includes shear studs 42, which extend into the concrete layer 40 and increase the composite interaction of the concrete 40 and the frame components 30.

Because frames 30 create an open space 32 between the opposing columns 20 when supporting the decking 90, a space enclosure 46 can be connected to the opposing frames 30. Where open space 32 is not used for the passage of the aforementioned utilities, the space enclosure 46 is required. The space enclosure 46 can be any geometric shape and may be comprised of more than one element (such as a deck profile and an angle profile shown in FIGS. 3A and 3B) as long as it substantially covers the area between columns 20 and frames 30. The space enclosure 46 lies within space 32 between frames 30 and seals part of open space 32 between frames 30 during pouring of the concrete 40, preventing the concrete 40 from flowing down and between frames 30. Reinforcement 60, such as steel bars (shown) or mats can be added to further reinforce the continuous layer of concrete 40. Additionally, blocking 44 can be connected to opposing beam elements 30 to stabilize frames 30. Blocking 44, depending on the shape and size of space enclosure 46, may also provide support for space enclosure 46.

Figure 4:
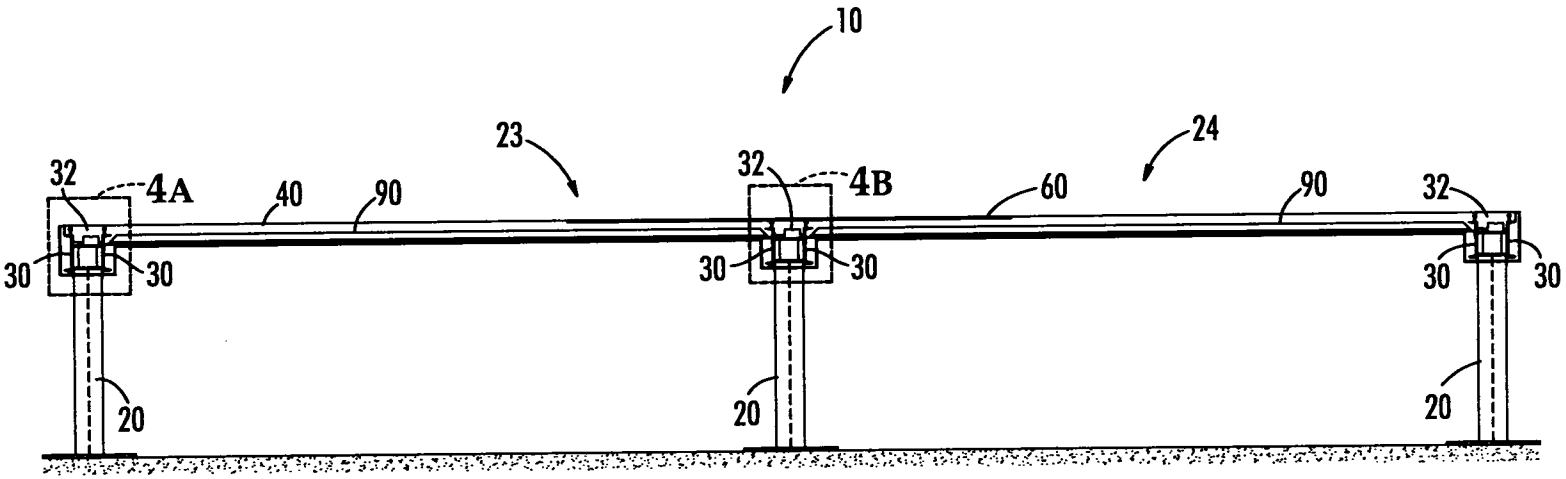
FIG. 4 is a cross-sectional view (taken at line 4-4 of FIG. 1) of exterior preassembled composite panels according to an alternative embodiment of the present invention.
Figure 4A:
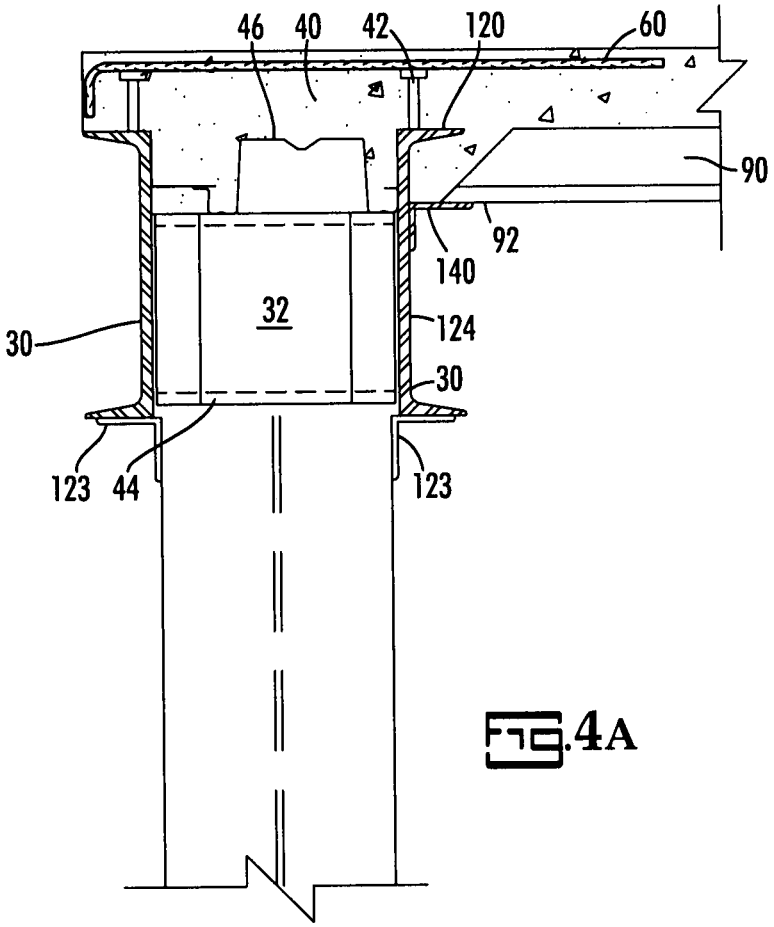
FIG. 4A is an enlarged cross-sectional view (taken at detail 4A of FIG. 4) of an exterior composite panel according to an alternative embodiment of the present invention.
Figure 4B:
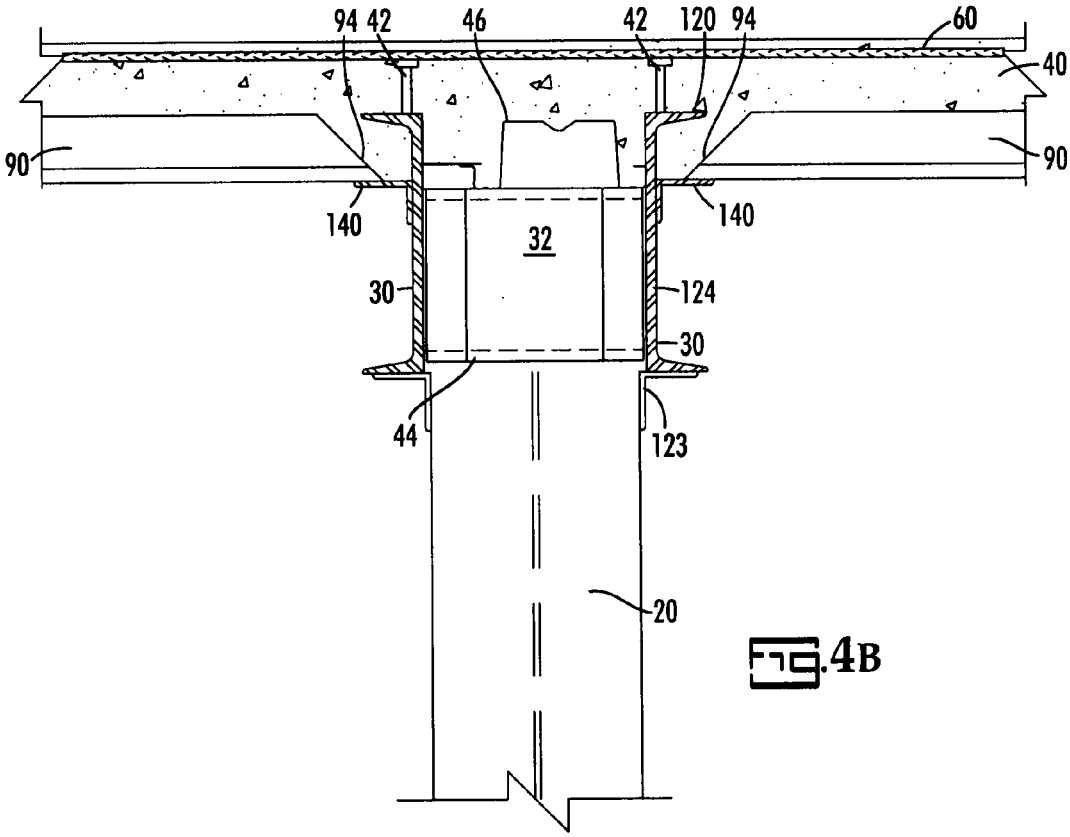
FIG. 4B is an enlarged cross sectional view (taken at detail 4B of FIG. 4) of an exterior composite panel according to an alternative embodiment of the present invention.

An alternative embodiment of the panelization system 10 of the present invention is shown in FIG. 4, which is a cross-sectional view taken at Section 4-4 of FIG. 1. Additionally, the areas of attachment of the panelization system 10 are shown in detail in FIGS. 4A and 4B. In addition to the previously described features of frame 30, the alternative embodiment shown in FIGS. 4, 4A, and 4B includes a floor or roof component ledger angle 140 that is attached to the web 124 of frame 30. Accordingly, this alternative embodiment of the present invention does not have decking 90 resting on the top flange 120 of frame component 30, but rather has the decking 90 resting on a floor or roof component ledger angle 140. This reduces the overall thickness of the floor or roof structure, providing flexibility in designing floor or roof to ceiling heights for multi-story buildings.

Figure 5:
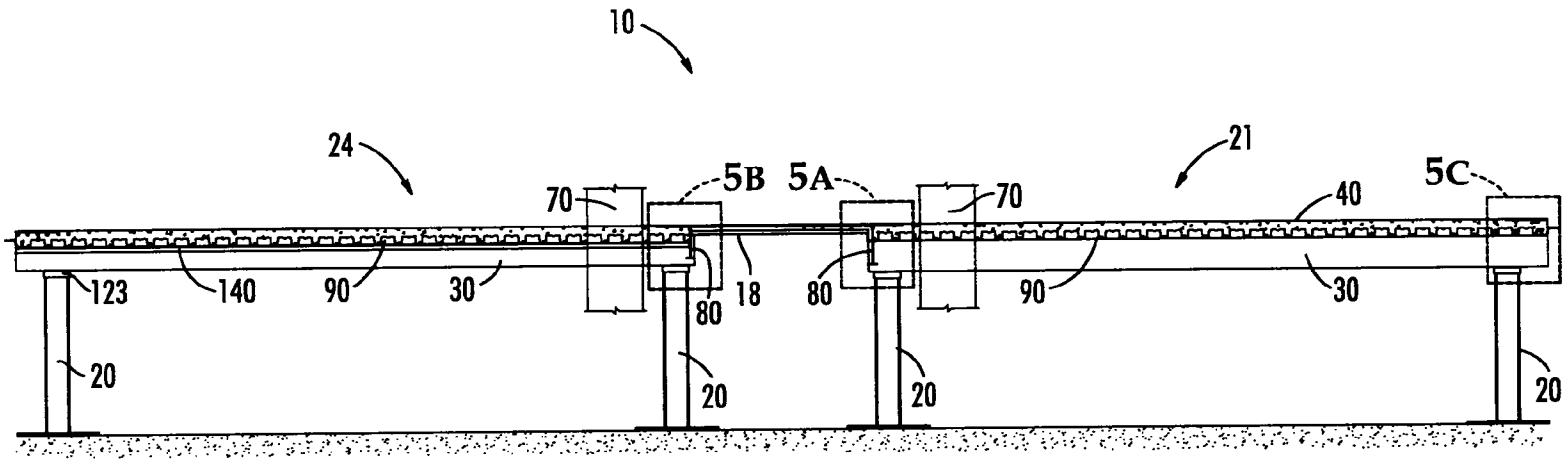
FIG. 5 is a cross-sectional view (taken at line 5-5 of FIG. 1) of one exterior composite panel according to one embodiment of the present invention, a second exterior composite panel according to an alternative embodiment of the present invention, and an interior field-installed panel.
Figure 5A:
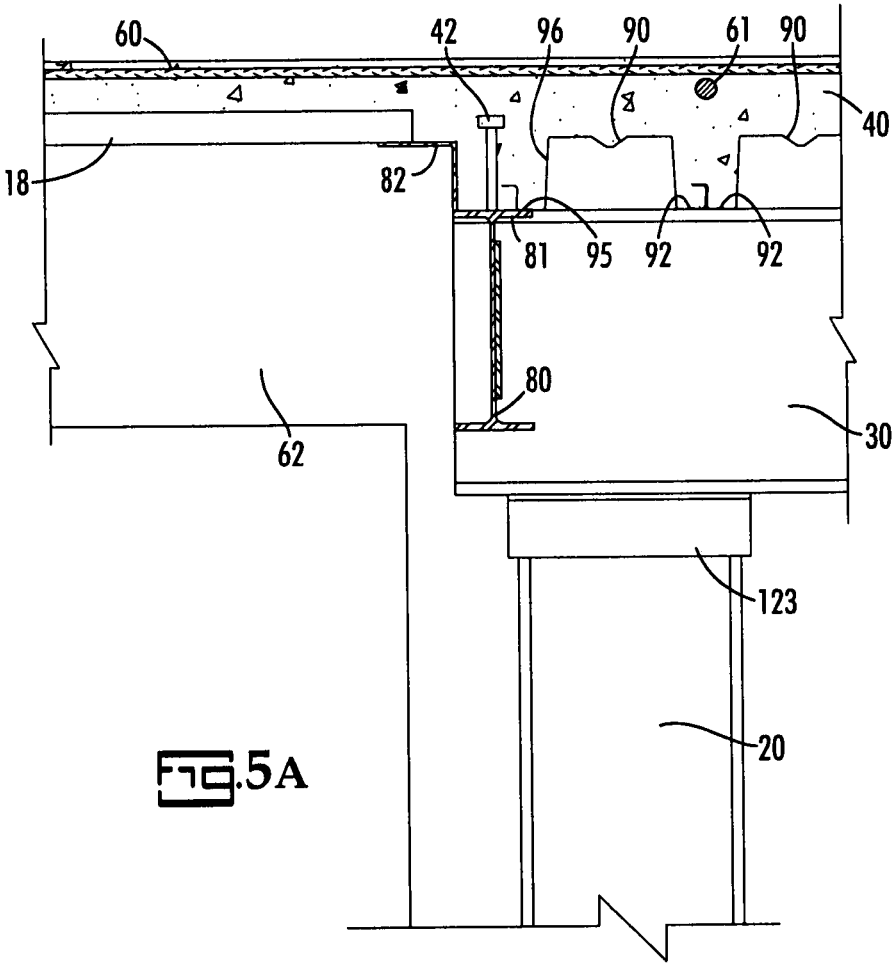
FIG. 5A is an enlarged cross-sectional view (taken at detail 5A of FIG. 5) of an interior field-installed panel according to one embodiment of the present invention.

FIG. 5 is a cross-sectional view (taken at line 5-5 of FIG. 1) of one exterior composite panel according to one embodiment of the present invention, a second exterior composite panel according to an alternative embodiment of the present invention and an interior field-installed panel. As previously discussed, optional interior partition 18 (as shown in FIG. 5A) can be used to span an interior space such as the corridor of a building. The interior beam 80 includes a top flange 81 that serves to support interior partition 18. Additionally, a bent plate 82 can be attached to the top flange 81. This bent plate 82, which can be attached by welding or other means, serves to support interior partition 18. A variety of shapes, combinations, and configurations can be used for interior beam 80 and bent plate 82.

The present invention can also include a spandrel beam system 15 used in conjunction with each floor or roof panel 21, 22, 23, and 24. By way of example and not limitation, a plan view of a panelization system 10 incorporating the spandrel beam system 15 is shown in FIG. 1 with spandrel beam system 15 installed along the exterior edges of the floor or roof panels 21, 22, 23, and 24. The features of one embodiment of spandrel beam system 15 are shown in detail in FIG. 5C. As can be seen in FIG. 5C, the spandrel beam system 15 is adjacent to decking 90 and includes reinforcing 61, such as continuous steel reinforcing bars or post-tensioned steel cables, a beam closure 13, a continuous pour stop member 85, optional shear studs 42, and a layer of concrete 40. Steel reinforcing bar 61 provides both bending and diaphragm shear resistance along the spandrel beam system 15. Optionally, a plurality of hooked steel reinforcing bars 60 can also be used in combination with the other reinforcing of the spandrel beam system 15 to support vertical and horizontal design loads.

As shown in FIG. 5C, the optional spandrel beam system 15 can provide support for a curtain wall 150. Although other shapes and dimensions may be employed, one embodiment of the spandrel beam system 15 includes a curtain wall support angle 35 that extends horizontally along the length of and supports the curtain wall 150.

A feature of the present invention includes the use of a continuous pour stop member 85 in combination with reinforcing, including continuous steel reinforcing bar 61 and hooked steel reinforcing bar 60. This feature provides bending reinforcement, diaphragm shear resistance, and support of the gravity and lateral loads of the curtain wall 150.

Still referring to FIG. 5C, the pour stop 85 includes a first flange 87 and a second flange 86. Although various shapes are contemplated, the first flange 87 of pour stop 85 can be about perpendicular with the second flange 86. The first flange 87 of pour stop 85 is adjacent to the flange 39 of the curtain wall support angle 35. Furthermore, the first flange 87 of pour stop 85 establishes the boundaries of the layer of concrete 40. The first flange 87 can be used as an attachment surface for attaching hooked steel reinforcing bars 60 to pour stop 85. As shown, the second flange 86 of the pour stop 85 can include optional shear studs 42 placed in a single row (shown) or multiple rows extending into the layer of concrete 40. Shear studs 42 can assist in the bonding of the layer of concrete 40 to pour stop 85 thereby increasing the composite strength of the spandrel beam system 15. In addition to the angle shown, other profile shapes (e.g., channels) can be used for pour stop 85 depending on the design requirements. The spandrel beam closure 13, which can be any shape, pre-formed, flat strip, sheet, or plate, is used to provide connection between the pour stop 85 and the outermost edge of the decking 90. In spanning any gap that may exist between pour stop 85 and decking 90, spandrel beam closure 13 prevents concrete 40 from flowing down and between pour stop 85 and decking 90.

Figure 6:
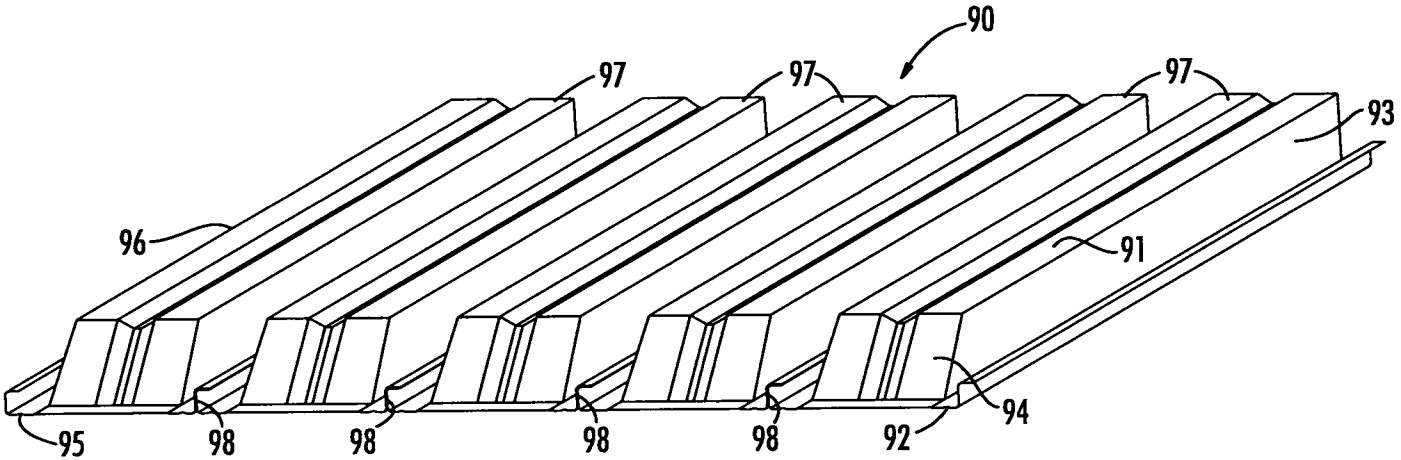
FIG. 6 is a perspective view of a plurality of panelized deck pans according to one embodiment of the present invention.

By way of example and not limitation, FIG. 6 shows decking 90 that can be used as both a suitable floor or roof component and partition component 18. Deck 90 can be, as shown in FIG. 6 for example, DEEP-DEK® by Consolidated Systems, Inc. Although numerous shapes and dimensions are contemplated by the present invention, the decking 90 can have longitudinally extending channels that can be formed by parallel, alternately positioned flats (bottom flange members) 92 and ribs (top flange members) 91 that are connected by side walls (vertical web members) 93. In particular, the decking 90 can be made of metal. Depending on the length and width required for the floor or roof component, decking 90 can be made of a continuous deck pan that covers the desired width and length or, as shown in FIG. 6, a plurality of deck pans 97 combined in juxtaposed relation to form the desired width and length. The deck pans 97 of this embodiment are joined along their raised hidden side lap 98 with an HSL DEK LOK™ tool (U.S. Pat. No. 7,353,584). Preferably, the decking 90 includes deck pans 97 having closed ends 94.

As illustrated in FIGS. 3A, 3B, 4A and 4B, decking 90 is attached to the frame 30 along the alternately positioned flats (bottom flange members) 92 of the decking 90. Accordingly, as shown in FIG. 5A, the decking 90 is preferably attached to the top flange 81 of interior beam 80 along an outermost flat 95 of an outermost deck section 96 of the decking 90.

Figure 5B:
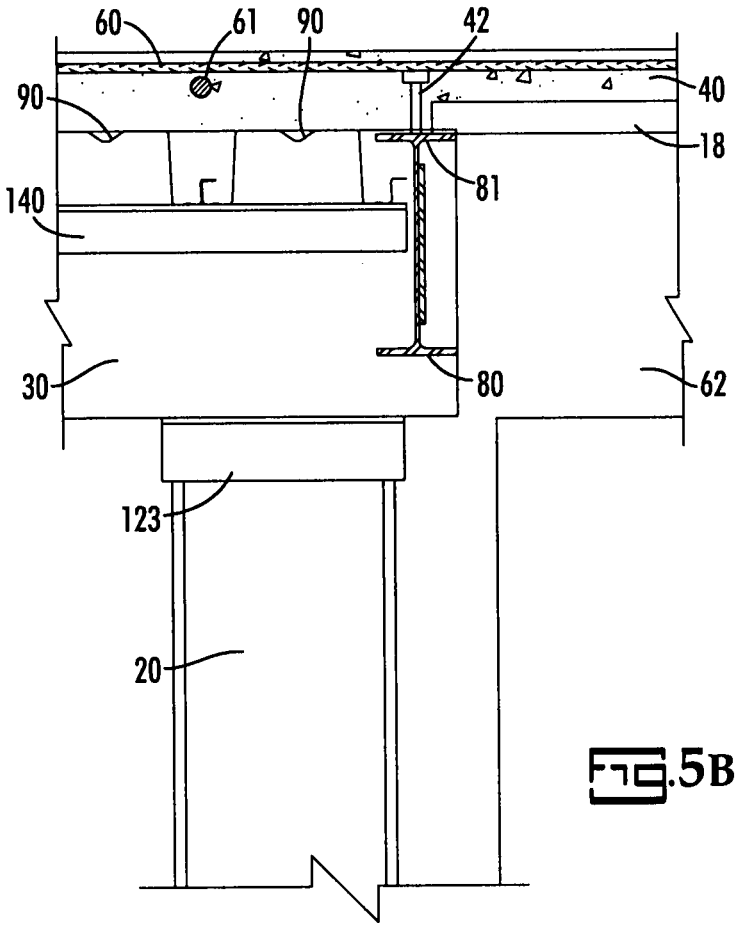
FIG. 5B is an enlarged cross-sectional view (taken at detail 5B of FIG. 5) of an interior field-installed panel according to an alternative embodiment of the present invention.
Figure 5C:
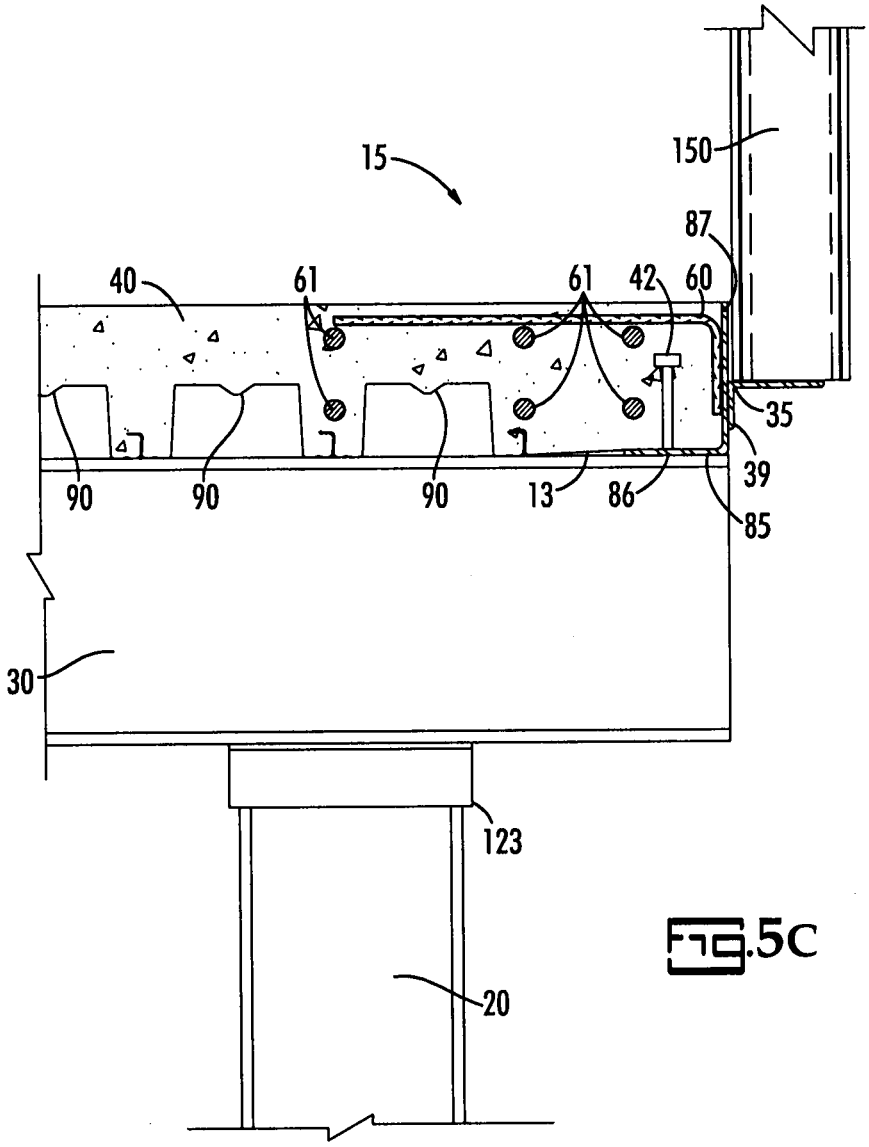
FIG. 5C is an enlarged cross-sectional view (taken at detail 5C of FIG. 5) of a cross-sectional view of a spandrel beam system, according to one embodiment of the present invention.

By way of example and not limitation, FIG. 5A and FIG. 5B show two means of attachment of the partition component 18 or 19 to the interior beam element 80 of the present invention. The preassembled partition component 19 or a field installed partition 18, such as, for example, VERSA-DEK® by Consolidated Systems, Inc., can be connected to the interior beam element 80 by way of the bent plate 82 (FIG. 5A) or by the top flange 81 (FIG. 5B).

Figure 7:
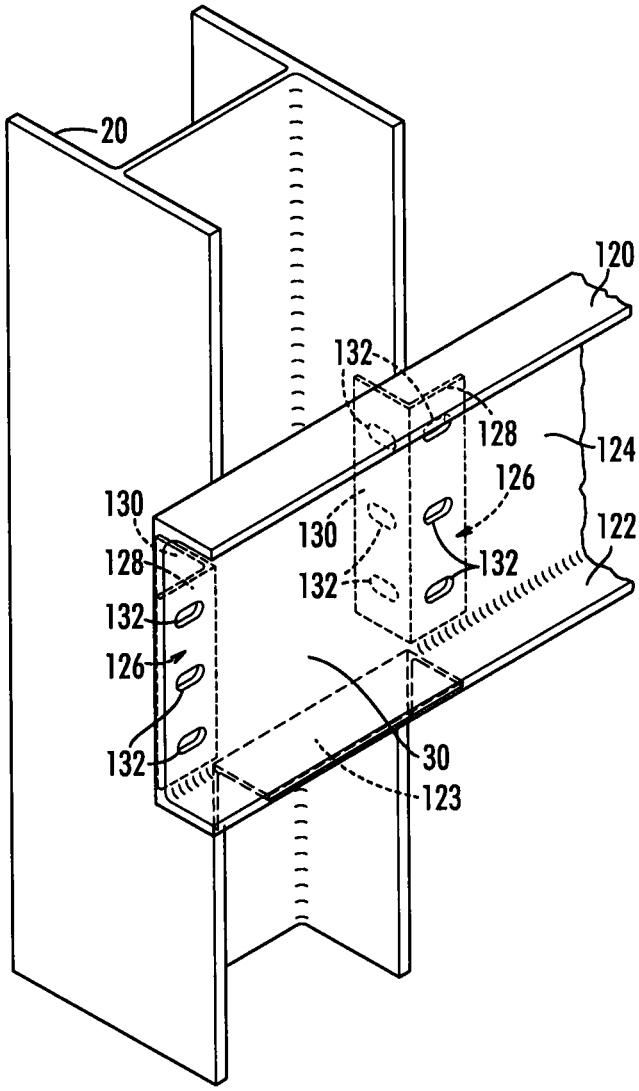
FIG. 7 is perspective view of a frame and column connection of a floor or roof panel according to one embodiment of the present invention.

FIG. 7 illustrates some particular features of the attachment of frame 30 to columns 20. By way of example and not limitation, the horizontal frame 30 is made of channel beams, and includes a top flange 120, a bottom flange 122, and a vertical web attachment surface 124. Although a variety of attachments can be employed to attach frame 30 to the columns 20, a slotted clip angle 126 can be used that is generally L-shaped. The clip angle 126 includes a beam attachment flange 128 that is connected to the vertical web attachment surface 124 of the frame 30, and a column attachment flange 130 that is connected to the column 20. Depending on the shape of the column 20, the slotted clip angle 126 can be used on opposing sides of column 20, assuming a four-sided column is employed. Furthermore, slots 132 are along both the beam element attachment flange 128 and the column attachment flange 130 to enable horizontal adjustment of the frame 30. Optionally, the bottom flange 122 of the frame 30 can be temporarily supported by a temporary support element 123 during installation of panelization system 10 before frames 30 are permanently attached to columns 20.

Figure 8:
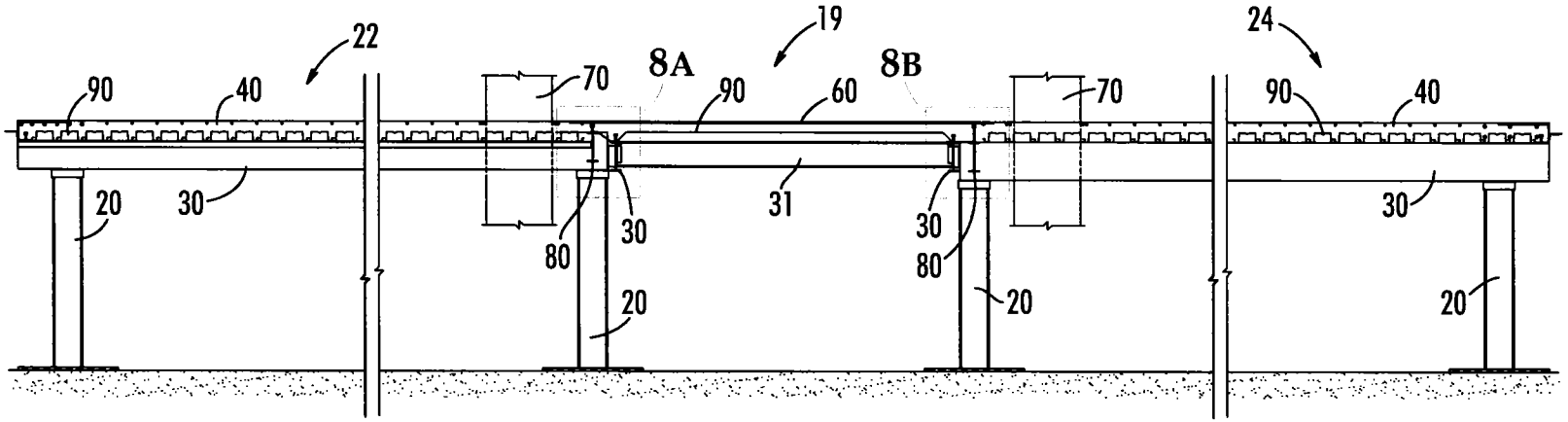
FIG. 8 is a cross-sectional view (taken at line 8-8 of FIG. 2) of one exterior composite panel according to one embodiment of the present invention, a second exterior composite panel according to an alternative embodiment of the present invention and a preassembled interior partition.

An alternative embodiment of the connection between adjacent floor or roof panels 21, 22, 23, and 24 includes the use of an interior preassembled partition 19, as shown in FIGS. 2 and 8. As previously discussed, the interior area between exterior panels of a building can be used as a corridor for the building. Much like decking 90 of the panels 21, 22, 23, and 24, the interior preassembled partition 19 is supported by frames 30 when the panelization system 10 method is employed (as shown in FIGS. 2 and 8) or interior frame elements 80 when the field installed method is employed (as shown in FIGS. 1 and 5).

Figure 8A:
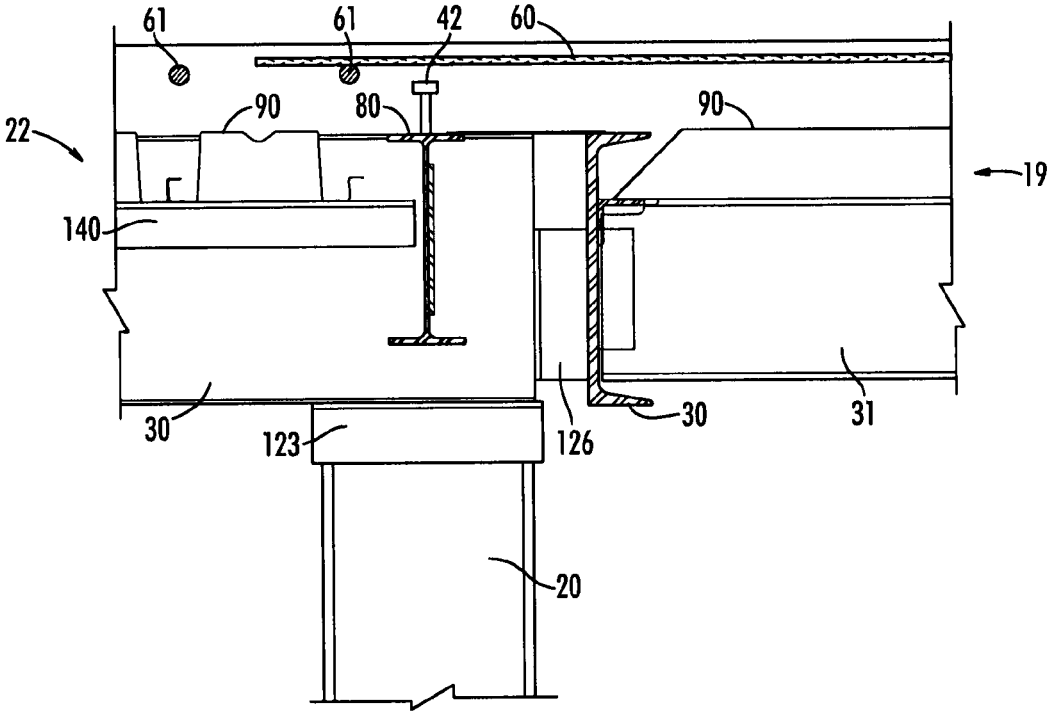
FIG. 8A is an enlarged cross-sectional view (taken at detail 8A of FIG. 8) of the connection between a preassembled interior partition panel and an exterior panel according to one embodiment of the present invention.
Figure 8B:
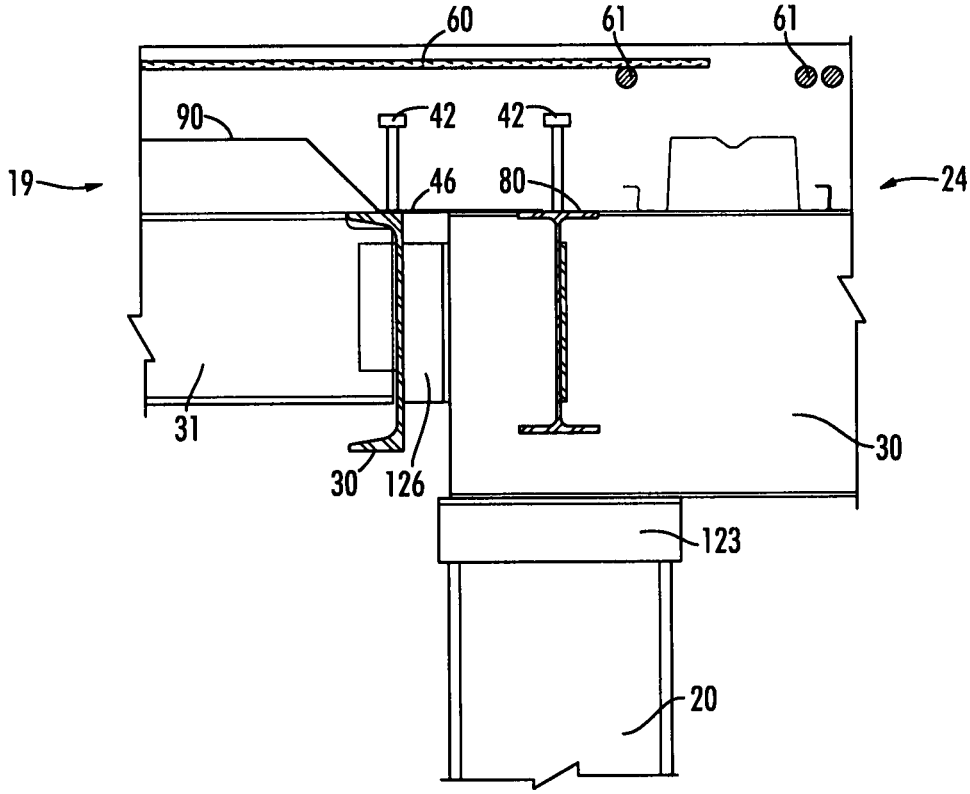
FIG. 8B is an enlarged cross-sectional view (taken at detail 8B of FIG. 8) of the connection between a preassembled interior partition panel and an exterior panel according to an alternative embodiment of the present invention.

FIGS. 8A and 8B, both detail drawings taken from FIG. 8, show the connection between the preassembled interior partition component 19 and the preassembled exterior panels 22 and 24, respectively. Note with respect to FIG. 8A that decking 90 of the preassembled exterior panel 22 is attached to ledger angle 140, which is mounted within the channel of frame member 30. Turning to FIG. 8B, note that decking 90 of this alternative embodiment of preassembled exterior panel 24 is attached to the top of frame member 30. The relative position of interior partition 19 with respect to exterior panels 22 and 24 can require differently shaped space enclosures 46 to be used, as seen in FIGS. 8A and 8B.

Figure 9:
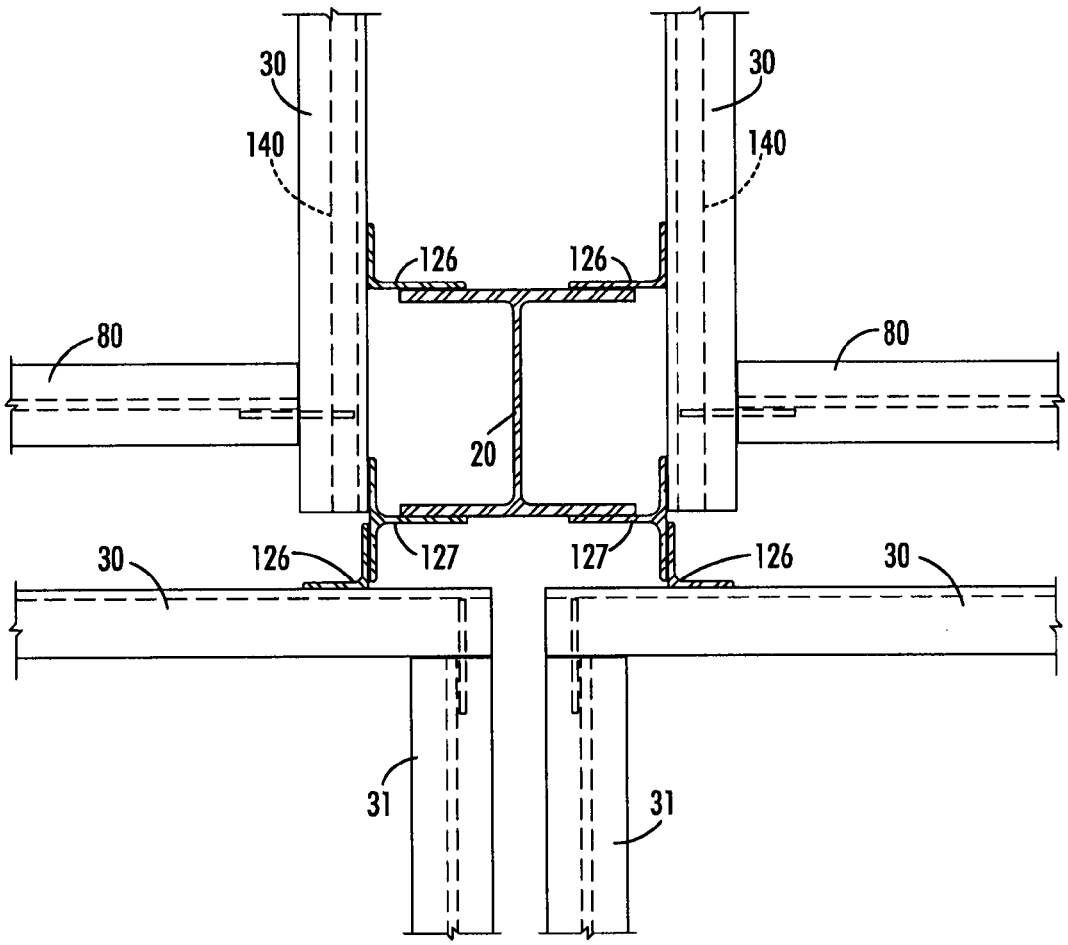
FIG. 9 is an enlarged plan view of the connection detail at the exterior and interior preassembled panel frames and column as shown in FIG. 2, according to an alternative embodiment of the present invention.

FIG. 9, a detail from FIG. 2, provides a closer view of the attachment of frames 30 to columns 20 using a series of slotted clip angles 126 and structural connectors 127. Depending on the size and dimension of the interior space, a number of interior partitions 19 can be used. In the embodiment shown in FIG. 2, two adjacent interior partitions 19 are shown. A variety of shapes and dimensions can be employed for the slotted clip angles 126 and the structural connectors 127, including L-shape and T-shape, respectively. Additionally, a variety of shapes and dimensions can be employed for the interior beams 31.

As shown in FIGS. 5A and 5B, a horizontal mechanical plenum 62 can be included beneath interior partition 18. Additionally, the features of the panelization system 10 allow for the strategic placing of access openings between the centerlines of the columns 20. An example of the location of these mechanical openings 70 is shown in FIGS. 1, 2, 5, and 8.

The present invention further includes a method for constructing a floor or roof using the panelization system 10. The steps of the method include: 1) providing columns 20 that are spaced apart so as to establish perimeters in a building construction or area within a building construction; 2) providing the frame 30 as previously described; 3) providing the floor or roof including decking 90; and 4) connecting the frame 30 and decking 90 to form panels 21, 22, 23, and 24. Alternative embodiments of the method of the present invention may also include one or more of the following steps: the use of spandrel beam system 15 instead of a beam 30 on one or more sides of the panel; pre-attaching some or all of the concrete reinforcing steel 60 or 61 to the panel; placing some or all of the concrete reinforcing steel 60 or 61 for distribution after panel installation on the panel; placing other construction materials for distribution after panel installation on the panel; elevating and positioning panels 21, 22, 23, and 24, and positioning panels 21, 22, 23, and 24, between columns 20; permanently connecting panels 21, 22, 23, and 24, to the columns 20; distributing and then attaching the concrete reinforcing steel 60 or 61; inserting blocking 44, if required, between frame members of adjacent panels; covering the space between frame members of adjacent panels with beam closures 46; and pouring a layer of concrete 40 over and around decking 90.

Those skilled in the art of panelization systems will recognize that many substitutions and modifications can be made in the foregoing embodiments without departing from the spirit and scope of the present invention.

What is claimed is:

1. A multi-story building, said building comprising:

(a) plural spaced-apart columns in an array, each column of said plural columns having two opposing sides, said two opposing sides of said each column being on the same sides as two opposing sides of any adjacent column of said plural columns;

(b) support elements attached to at least one opposing side of said two opposing sides of said plural columns, said support elements attached at plural elevations on said columns;

(c) clip angles attached to said plural columns proximate to said support elements;

(d) plural panels, each panel of said plural panels including a frame composed of interconnected beams, and a deck attached to said frame, said deck being composed of interconnected decking units, wherein said each beam of said frame rests on said support elements at an elevation and against one side of said opposing sides of said columns and is attached to said columns by said clip angles with said frame, and wherein each two adjacent panels are supported by columns with said two adjacent panels separated by and supported on two columns of said columns thereby defining a space between said two adjacent panels.

2. The building as recited in claim 1, wherein said each column has four or more sides.

3. The building as recited in claim 1, wherein said frame has four beams.

4. The building as recited in claim 1, wherein said decking units are steel profiles.

5. The building as recited in claim 1, wherein said deck further includes a layer of concrete.

6. The building as recited in claim 1, wherein said beams are channel beams or I-beams.

7. The building as recited in claim 1, wherein one beam of said plural beams is a spandrel beam.

8. The building as recited in claim 1, wherein said each support element has a top flange and wherein said panel rests on said top flange.

9. The building as recited in claim 1, wherein said each support element has a flange and wherein said panel rests on said flange.

10. The building as recited in claim 1, wherein said each clip angle is a slotted clip angle.

11. The building as recited in claim 1, wherein two clip angles are attached proximate to said each support element.

12. A multi-story building, said building comprising:

(a) plural spaced-apart columns, each column of said plural columns having two opposing sides and a centerline, said two opposing sides of said each column being on the same sides as two opposing sides of an adjacent column, said centerline of said each column running between said each column and said adjacent column;

(b) plural support elements, a support element of said plural support elements being attached to each side of said opposing sides of said each column and to each side of said adjacent column;

(c) plural clip angles, a clip angle of said plural clip angles being attached proximate to each support element of said plural support elements;

(d) plural panels, each panel of said plural panels including a frame and a deck attached to said frame, said frame composed of interconnected beams, one beam of said interconnected beams being a spandrel beam, wherein a beam of said interconnected beams of said frame of said panel rests on said support elements of said each column and said adjacent column and is attached to clip angles of said plural clip angles adjacent said support elements, wherein beams of each two adjacent panels of said plural panels are carried on opposing sides of said each column and said adjacent column and rest on said support elements attached to said opposing sides of said each column and adjacent column, with said each column and said adjacent column being between said beams of said two adjacent panels thereby defining a space between said two adjacent panels and said each column and said adjacent column, said space running parallel to said centerline of said each column and said adjacent column, and wherein said spandrel beam comprises:

a pour stop;

a spandrel beam closure that connects said deck to said pour stop;

a layer of concrete integral with said deck, said pour stop, and said spandrel beam closure; and reinforcing in said layer of concrete, and wherein said pour stop has a first flange;

a second flange, said second flange being substantially perpendicular to said first flange, and a curtain wall support being attached to said first flange.

13. The building as recited in claim 12, wherein said reinforcing comprises rebar and hooked rebar, said hooked rebar attached to said pour stop.

14. A multi-story building, said building comprising:

(a) plural spaced-apart columns in an array, each column of said plural columns having two opposing sides, said two opposing sides of said each column being on the same sides as two opposing sides of any adjacent column of said plural columns;

(b) support elements attached to at least one opposing side of said two opposing sides of said plural columns, said support elements attached at plural elevations on said columns;

(c) clip angles attached to said plural columns proximate to said support elements;

(d) plural panels, each panel of said plural panels including a frame composed of interconnected beams, and a deck attached to said frame, said deck being composed of interconnected decking units, wherein said each beam of said frame rests on said support elements at an elevation and against one side of said opposing sides of said columns and is attached to said columns by said clip angles with said frame, and wherein each two adjacent panels are supported by columns with said two adjacent panels separated by and supported on two columns of said columns thereby defining a space between said two adjacent panels; and (e) a layer of concrete on said plural panels.

* * * * *